US006327868B1

(12) United States Patent
Furuya et al.

(10) Patent No.: US 6,327,868 B1
(45) Date of Patent: Dec. 11, 2001

(54) REFRIGERATING CYCLE

(75) Inventors: Shunichi Furuya; Kiyoshi Tanda, both of Kanda (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 0 days.

(21) Appl. No.: 09/743,137

(22) PCT Filed: Oct. 19, 1998

(86) PCT No.: PCT/JP98/04705

§ 371 Date: Jan. 5, 2001

§ 102(e) Date: Jan. 5, 2001

(87) PCT Pub. No.: WO00/23752

PCT Pub. Date: Apr. 27, 2000

(51) Int. Cl.[7] ..... F25B 41/00
(52) U.S. Cl. ..... 62/197; 62/129
(58) Field of Search ..... 62/197, 228.3, 62/126, 127, 129, 475

(56) References Cited

U.S. PATENT DOCUMENTS 3,603,105 * 9/1971 Mamaroneck ..... 62/228.3
4,304,102 * 12/1981 Gray ..... 62/475
5,531,077 * 7/1996 Formenti ..... 62/197
6,170,277 * 1/2001 Porter et al. ..... 62/228.3

FOREIGN PATENT DOCUMENTS 3-503206 7/1991 (JP) .
7-502335 3/1995 (JP) .

* cited by examiner

*Primary Examiner*—William E. Tapolcai
*Assistant Examiner*—Mohammad M. Ali
(74) *Attorney, Agent, or Firm*—Wenderoth, Lind & Ponack, L.L.P.

(57) ABSTRACT

In a freezing cycle, if the pressure in a high-pressure line (8) reaches an abnormal level, the high-side pressure is released toward a low-pressure line (9) to lower the pressure without releasing the coolant into the atmosphere and the coolant is released into the atmosphere only when the pressure in the low-pressure line (9) reaches an abnormal level. A first means for a safety (10) that communicates between the high-pressure line (8) and the low-pressure line (9) is provided and a second means for safety (11) is provided between the low-pressure line (9) and the atmosphere, so that if the high-side pressure reaches a level equal to or higher than a first pressure level, the first means for safety (10) is engaged to leak the high-pressure coolant in the high-pressure line (8) into the low-pressure side to allow the increase in the pressure in the high-pressure line (8) to be absorbed in the low-pressure line (9), thereby lowering the pressure in the high-pressure line without releasing coolant to the outside. Since the coolant is released into the atmosphere by the second means for safety only if the pressure in the low-pressure line (9) reaches a level equal to or higher than a second pressure, the quantity of coolant released to the outside of the freezing cycle is minimized.

37 Claims, 13 Drawing Sheets

REFRIGERATING CYCLE

TECHNICAL FIELD

The present invention relates to a freezing cycle in which a coolant compressed by a compressor reaches a point equal to or higher than the critical point, having a structure for protecting the various components employed in the freezing cycle when the level of the high-side pressure becomes abnormally high.

BACKGROUND ART

Among the supercritical coolants such as ethylene (C2H4), diborane (B2H6), ethane (C2H5), nitrogen oxide (N2O) and carbon dioxide (CO2) that may be used in the supercritical steam compression cycle disclosed in Japanese Examined Patent Publication No. H 7-18602 comprising, at least, a compressor, the cooling device, a means for constriction and an evaporator, carbon dioxide (CO2) is the primary coolant that is mainly utilized.

This supercritical steam compression cycle is one of the non-freon freezing cycle proposed as replacements for freon freezing cycles, and freezing cycles that use carbon dioxide in particular, are considered promising replacements for freon freezing cycles.

However, since carbon dioxide has a low critical point of approximately 31.1° C., the external air temperature may exceed the critical point, especially during summer. In addition, during a freezing cycle operation, too, the high-pressure line (extending from the compressor to the means for constriction) in the freezing cycle naturally constitutes a supercritical area, and the pressure in the supercritical area where the temperature exceeds the critical point, which is determined by the density and the temperature, may exceed 20 MPa if the temperature is very high.

As described above, while it is necessary to ensure that all the components conform to specifications for withstanding super-high pressures in the freezing cycle in which the operating pressure is extremely high compared to that in a freon freezing cycle, there is a problem in that an improvement in the pressure withstanding performance will result in increases in the weight and production cost of the product. In other words, while it is desirable to use aluminum to constitute the components to achieve a reduction in the weight, the operating pressure in a heat exchanger or the like, in particular, cannot exceed 20 MPa at present in consideration of the pressure withstanding performance determined in conjunction with the heat exchanging capability and the strength.

Accordingly, a safety mechanism that discharges the coolant into the atmosphere when the high-side pressure exceeds a specific level may be provided. However, there is a problem in that the coolant released into the atmosphere must be replenished.

Addressing the problems discussed above, an object of the present invention is to provide a freezing cycle in which the high-side pressure can be reduced without having to release the coolant into the atmosphere in the event of a high-side pressure abnormality and the coolant is released into the atmosphere only in the event of a low-side pressure abnormality.

SUMMARY OF THE INVENTION

Accordingly, the freezing cycle according to the present invention, which comprises, at least, a compressor that compresses a gas-phase coolant to achieve a supercritical pressure, a radiator that cools the gas-phase coolant compressed by the compressor, a means for constriction that lowers the pressure of the cooled gas-phase coolant down to a range in which liquid-phase coolant is present and an evaporator that evaporates the liquid-phase coolant obtained through the means for constriction, having a high-pressure line extending from the compressor to the means for constriction and a low-pressure line extending from the means for constriction to the compressor, is further provided with a first means for safety that communicates between the high-pressure line and the low-pressure line if the pressure in the high-pressure line reaches a first pressure and a second means for safety provided at the low-pressure line, that opens the low-pressure line to the atmosphere if the pressure in the low-pressure line reaches a second pressure.

Thus, according to the present invention, in which the first means for safety is provided between the high-pressure line and the low-pressure line to leak the high-pressure coolant in the high-pressure line toward the low-pressure side by opening a first valve if an abnormality occurs in the freezing cycle and the high-side pressure reaches a level equal to or higher than the first pressure, the increase in the pressure in the high-pressure line is absorbed in the low-pressure line to reduce the pressure in the high-pressure line, thus preventing the high-side pressure from rising without having to release the coolant. In addition, the coolant is released into the atmosphere by the second means for safety only if the pressure in the low-pressure line reaches a level equal to or higher than the second pressure due to an abnormal increase in the pressure in the low-pressure line caused by an inflow of a high-side pressure from the high-pressure line or an abnormality in the freezing cycle itself, since the safety of the individual components in the low-pressure line will no longer be assured. Consequently, since if the release of coolant from the freezing cycle is minimized, wasteful loss of coolant is prevented.

In addition, the freezing cycle further comprises a first heat exchanger located between the radiator and the means for constriction and a second heat exchanger located between the evaporator and the compressor, and is also provided with an internal heat exchanger which engages in heat exchange between the first heat exchanger and the second heat exchanger, with the first means for safety provided between the first heat exchanger and the second heat exchanger and the second means for safety provided between the second heat exchanger and the atmosphere.

Furthermore, the second means for safety may be provided inside the compressor to open the intake side of the compressor to the atmosphere if the pressure on the intake side of the compressor reaches the second pressure, or the first means for safety may be provided inside the compressor to communicate between the outlet side and the intake side of the compressor if the pressure on the outlet side of the compressor reaches a level equal to or higher than the first pressure.

Alternatively, in a freezing cycle which comprises, at least, a compressor that compresses a gas-phase coolant to achieve a supercritical pressure, a radiator that cools the gas-phase coolant having been compressed by the compressor, a means for oil separation that is provided on the downstream side relative to the radiator and separates oil from the cooled coolant, a first means for constriction that lowers the pressure of the gas-phase coolant having undergone the oil separation at the means for oil separation down to a range in which a liquid-phase coolant is present, a means for gas/liquid separation that separates the coolant that has been set in a gas/liquid mixed state by the first means for constriction into a gas-phase component and a liquid-phase component, a second means for constriction that further reduces the pressure of the liquid-phase coolant resulting from the separation at the means for gas/liquid separation and an evaporator that evaporates the liquid-phase coolant with its pressure having been lowered by the second means for constriction, having a high-pressure line extending from the compressor to the first means for constriction, an intermediate-pressure line extending from the first means for constriction to the second means for constriction and a low-pressure line extending from the second means for constriction to the compressor, the first means for safety is provided between the means for oil separation and the means for gas/liquid separation to communicate between the high-pressure line and the intermediate-pressure line at the first pressure and the second means for safety is provided between the means for gas/liquid separation and the atmosphere to communicate between the intermediate-pressure line and the atmosphere when the pressure reaches a third level, higher than the second pressure.

In the structure described above, in which the first means for safety communicates between the means for oil separation and the means for gas/liquid separation if the high-side pressure reaches a level equal to or higher than the first pressure to release the pressure in the high-pressure line into the intermediate-pressure line, an increase in the high-side pressure is prevented. In addition, with the intermediate-pressure line and the atmosphere made to communicate with each other by the second means for safety at a pressure equal to or higher than the third pressure, an increase in the steady-state pressure is prevented.

The means for constriction may be constituted of an expansion valve and the first means for safety may communicate between the upstream side and the downstream side of the expansion valve.

In addition, it is desirable to set the first pressure in within a range between 12 MPa which is the standard high-side pressure in a freezing cycle and 20 MPa in consideration of the pressure withstanding property of aluminum and to set the second pressure within a range over which the pressure withstanding safety of the evaporator can be assured when the level of the pressure on the low-pressure side is raised by the high-side pressure caused to bypass toward the low-pressure side, e.g., within a range of 8 MPa~15 MPa.

It is desirable to constitute the first means for safety with a valve that operates at the absolute pressure on the high-pressure side by engaging a bellows or a diaphragm at the first pressure and to constitute the second means for safety with a rupture disk mechanism having a rupture disk which becomes ruptured at the second pressure. Especially, by providing the rupture disk mechanism, a leak of the low-side pressure which would otherwise occur until the pressure reaches a specific level can be completely prevented.

As an alternative, the first means for safety and the second means for safety may be each constituted of an electromagnetic valve that operates in response to a signal output by a sensor provided to detect the pressure at a specific position or in response to a control signal output by a control unit that receives and processes the signal from the sensor. While the structure is bound to become more complicated in this case, finer control is enabled.

Moreover, the second means for safety may be constituted of a relief valve that opens the low-pressure line to the atmosphere if the low-side pressure reaches a level equal to or higher than a pressure set by a spring (the pressure determined by the spring and the pressure difference between the low-side pressure and the atmospheric pressure). In this structure, when the low-side pressure is lowered to a level equal to or lower than the specific level, a recovery is enabled.

THE BEST MODE FOR CARRYING OUT THE INVENTION

The following is an explanation of the embodiments of the present invention, given in reference to the drawings.

Figure 1:
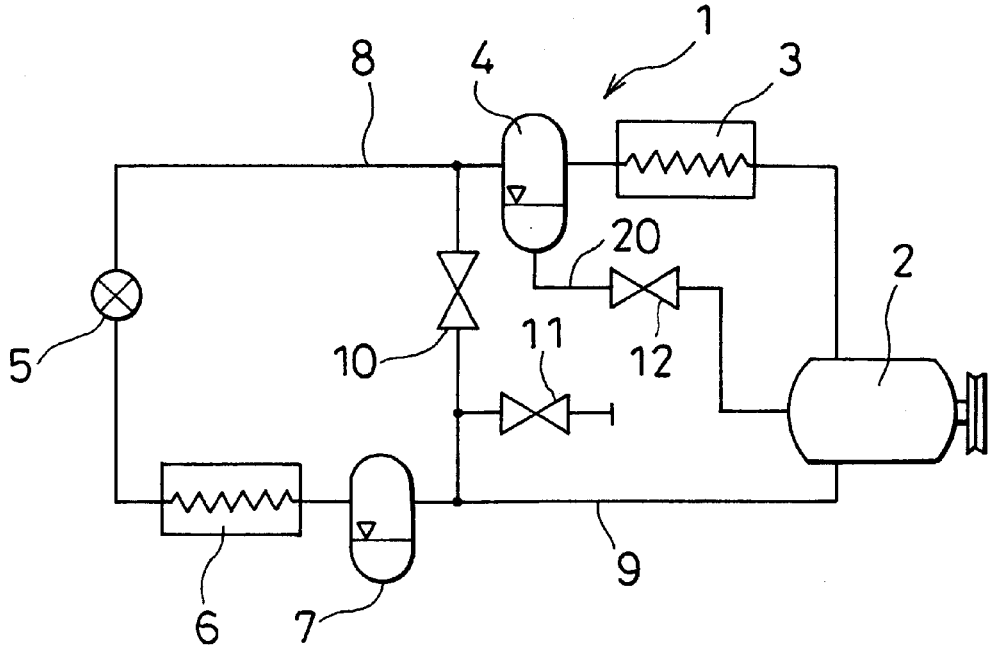
FIG. 1 is a schematic block diagram of the freezing cycle in a first embodiment of the present invention.

FIG. 1 illustrates a freezing cycle 1 in the first embodiment of the present invention. This freezing cycle 1, which uses carbon dioxide ($CO_2$) as the coolant, comprises a compressor 2 that compresses the coolant to achieve a pressure within the supercritical range, a radiator (gas cooler) 3 that cools the coolant compressed by the compressor 2, an oil separator 4 that separates the lubricating oil from the coolant cooled by the gas cooler 3, an expansion valve 5 that serves as a constriction means and lowers the pressure of the coolant down to a gas/liquid mixed range, an evaporator 6 that evaporates the liquid-phase coolant component resulting from the pressure reduction achieved through the expansion valve 5 and an accumulator 7 that achieves gas/liquid separation for the coolant flowing out of the evaporator 6 and returns the gas-phase component alone to the compressor 2, and discharges the heat absorbed at the evaporator 6 through the gas cooler 3 via the coolant. It is to be noted that the range extending from the outlet side of the compression mechanism within the compressor 2 to the intake of the expansion valve 5 constitutes a high-pressure line 8 and that the range extending from the outlet of the expansion valve 5 to the intake side of the compression mechanism inside the compressor 2 constitutes a low-pressure line 9. In addition, the oil resulting from the separation achieved at the oil separator 4 is returned to the compressor 2 via an oil return line 20, and the quantity of returning oil is controlled through a valve 12.

Since the critical point of carbon dioxide is approximately 31.1° C., the high-pressure line 8 in the freezing cycle is in the supercritical range during the summer when a external air temperature exceeds the critical point and the high-pressure line 8 in the freezing cycle is also naturally in the supercritical range exceeding the critical point during an operation of the freezing cycle. The pressure in the supercritical range exceeding the critical point is determined by the density and temperature of the coolant, and the pressure in the high-pressure line 8 may exceed 20 MPa at a high temperature.

While it is necessary to improve the pressure withstanding performance of the various components (the gas cooler 3, the oil separator 4, other components such as piping, connectors and the like) on the high-pressure line 8 accordingly, the gas cooler 3 in particular among the components on the high-pressure line 8 should be constituted of aluminum in order to minimize its weight, and thus, the pressure withstanding capability determined in conjunction with the strength of the gas cooler 3 and the heat exchanging capability sets the upper limit of the operating pressure to approximately 20 MPa.

While no problem occurs as long as the freezing cycle is engaged in operation at a pressure of approximately 12 MPa, which is the standard high-side pressure, the pressure withstanding performance of the gas cooler 3 in particular becomes an issue if the high-side pressure exceeds 20 MPa as described above. As a solution, a first valve 10 that communicates between the high-pressure line 8 and the low-pressure line 9 is provided as a first means for safety in the present invention so that when the pressure in the high-pressure line 8 reaches a level equal to or higher than a specific level (a pressure within a range of 12 MPa~20 MPa), the high-pressure coolant in the high-pressure line 8 is allowed to flow toward the low-pressure line 9 to reduce the high-side pressure to a level lower than the specific pressure. In addition, since the coolant is not released to the outside of the freezing cycle, the coolant quantity remains unchanged.

In more specific terms, since it is not necessary to release the coolant into the atmosphere when the high-side pressure is temporarily caused to rise suddenly but the abnormality in the high-side pressure is eliminated by opening the first valve over a short period of time or when the quantity of the high-pressure coolant having flowed into the low-pressure line 9 is within the allowable range for the low-pressure line 9 and is thus, the increase in the pressure in the low-pressure line stays within the allowable range, the rise in the high-side pressure is suppressed in the low pressure line.

However, if the degree of the pressure increase in the low-pressure line 9 exceeds the allowable range or if the coolant pressure inside the entire freezing cycle 1 rises due to an increase in the external air temperature or the like while the freezing cycle 1 is in a non-operating state, the increase in the pressure cannot be absorbed anywhere within the freezing cycle 1. Accordingly, a second valve 11 that communicates between the low-pressure line 9 and the atmosphere if the pressure within the low-pressure line 9 reaches a level equal to or higher than a specific pressure is provided as a second means for safety, and by opening the second valve 11, the low-pressure line 9 is opened to the atmosphere to allow the coolant to be released until the pressure in the low-pressure line 9 becomes lower than the specific pressure level. Thus, the freezing cycle 1 is provided with a double safety mechanism.

It is to be noted that the first and second valves may be each constituted of a relief valve, a valve that employs a bellows or a diaphragm, an electromagnetic valve or the like.

Figure 2:
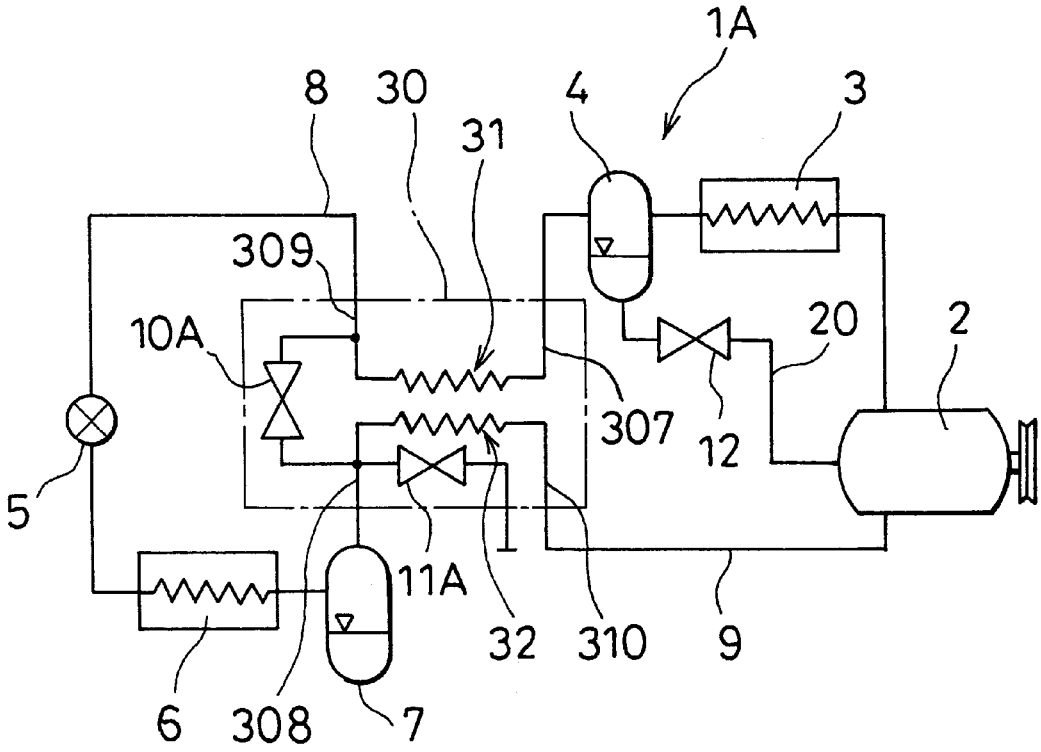
FIG. 2 is a schematic block diagram of the freezing cycle in a second embodiment of the present invention.

In the following explanation of other embodiments, the same reference numbers are assigned to components having structures or functions identical to those in the first embodiment to preclude the necessity for repeated explanation thereof. First, a freezing cycle 1A in FIG. 2 is provided with an internal heat exchanger 30 constituted of a first heat exchanger 31 that links the downstream side of the oil separator 4 and the expansion valve 5 and a second heat exchanger 32 that communicates between the downstream side of the accumulator 7 and the compressor 2 to achieve heat exchange between the high-temperature coolant flowing through the first heat exchanger 31 and the low temperature coolant flowing through the second heat exchanger 32.

In this embodiment, a first valve 10A is provided between the first heat exchanger 31 located at the high-pressure line 8 and the second heat exchanger 32 located at the low-pressure line 9 and a second valve 11A is provided between an intake 308 or an outlet of the second heat exchanger 32 located at the low-pressure line 9 and the atmosphere, to achieve advantages similar to those realized in the first embodiment.

Figure 3:
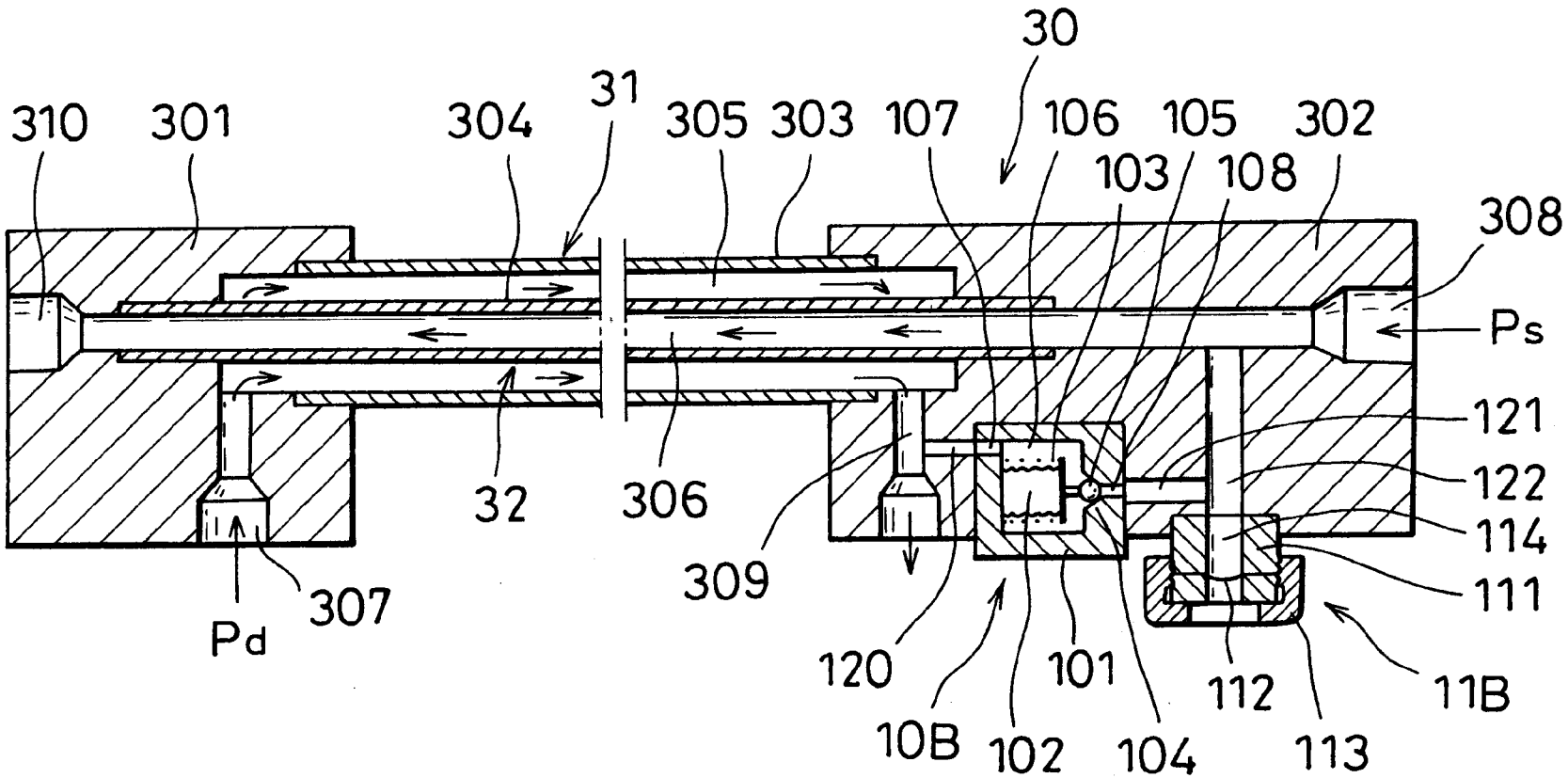
FIG. 3 is a sectional view of the structure of the internal heat exchanger in a third embodiment.

FIG. 3 illustrates an internal heat exchanger 30 having the first means for safety and the second means for safety provided as an integrated unit, with the first means for safety constituted of a bellows-type valve and the second means for safety constituted of a rupture disk mechanism.

In FIG. 3, the internal heat exchanger 30 in the third embodiment is provided with a pair of blocks 301 and 302 and a pair of coaxial pipes (an outer pipe and an inner pipe) 303 and 304 that communicate between the blocks 301 and 302.

The outer pipe 303 communicates between a high-pressure side intake passage portion 307 formed at the block 301 through which the coolant at a high pressure Pd flows in and a high-pressure side outlet passage portion 309 formed at the block 302 through which the coolant flows out. The inner pipe 304 which is to be detailed below passes through the outer pipe 303. It is to be noted that the outer pipe 303 constitutes the first heat exchanger 31.

The inner pipe 304, which communicates between a low-pressure side intake passage portion 308 formed at the block 302 through which the coolant at a low pressure Ps flows in and a low-pressure side outlet passage portion 310 formed at the block 301 through which the coolant flows out, constitutes the second heat exchanger 32.

At the internal heat exchanger 30, a bellows-type valve 10B is provided as the first means for safety and a rupture disk mechanism 11B which becomes ruptured at a specific pressure level is provided as the second means for safety instead of the valve explained earlier.

The bellows-type valve 10B is provided with a valve housing 101 which is mounted at the block 302 and a high-pressure space 106 is defined within the valve housing 101 with a bellows 102 provided within the high-pressure space of 106. In addition, the high-pressure space 106 communicates with the high-pressure side outlet passage portion 309 via a high-pressure side communicating hole 107 formed at the valve housing 101 and a high-pressure induction passage 120 formed at the block 302, and also communicates with the low-pressure side intake passage portion 308 via a low-pressure side communicating hole 108 formed at the valve housing 101 and a low-pressure side communicating passage 121 and a low-pressure induction passage 122 formed at the block 302. A valve seat 104 is formed at the low-pressure side communicating hole 108 on the side located toward the high-pressure space 106 and the low-pressure side communicating hole 108 becomes closed when a valve element 105 becomes seated at the valve seat 104.

A force is applied to the valve element 105 linked to an end of the bellows 102 toward the valve seat by a spring 103 provided around the bellows 102.

A vacuum gas or a gas at atmospheric pressure or at a specific pressure is sealed inside the bellows 102 and the bellows 102 becomes constricted only when the high-side pressure within the high-pressure space 106 reaches a level equal to or higher than a specific pressure to disengage the valve element 105 from the valve seat 104 to allow the coolant in the high-pressure line to leak into the low-pressure line. In other words, the valve element 105 is caused to move by the bellows 102 at the absolute pressure in the high-pressure line.

In addition, the rupture disk mechanism 11B, which is mounted at the front end of the low-pressure induction passage 122, is constituted of a rupture disk 112 which becomes ruptured at a specific pressure (the second pressure), a holding portion 111 that holds the rupture disk 112 and a retaining portion 113 that retains the rupture disk 112 at the holding portion 111. The rupture disk 112, which blocks an outlet hole 114 communicating with the low-pressure induction passage 122 becomes ruptured at the specific pressure to allow communication between the atmosphere and the outlet hole 114. As a result, the coolant in the low-pressure line is released into the atmosphere if the low-side pressure reaches the specific pressure to assure safety of the various devices.

Figure 4:
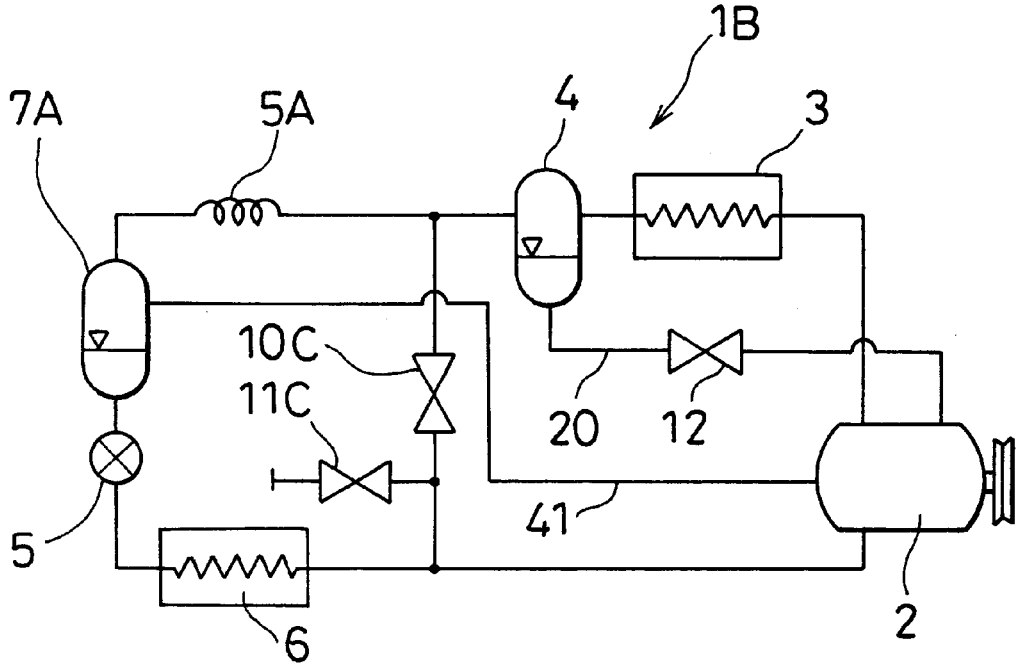
FIG. 4 is a schematic block diagram of the freezing cycle in a fourth embodiment.

A freezing cycle 1B in the fourth embodiment illustrated in FIG. 4 is characterized by an orifice tube 5A provided on the downstream side of the oil separator 4 constituting a first means for constriction and a gas/liquid separator 7A provided further downstream relative to the orifice tube 5A. In this structure, the pressure of the high-pressure coolant (gas-phase coolant) is lowered to an intermediate pressure within the gas/liquid mixed range and the coolant thus set in the gas/liquid mixed state is separated into a gas-phase coolant and a liquid-phase coolant at the gas/liquid separator 7A. Then, the gas-phase coolant obtained through the separation at the gas/liquid separator 7A is returned to the intake side of the compressor 2 via a gas-phase coolant return line 41, whereas the pressure of the liquid-phase coolant is reduced to the low-pressure range through the expansion valve 5. Thus, the pressure of the liquid-phase coolant alone is reduced at the expansion valve 5 and the liquid-phase coolant alone is evaporated at the evaporator 6, to increase the endothermic effect. In addition, by providing a first valve 10C and a second valve 11C similar to those in the first embodiment in the freezing cycle 1B in this embodiment, too, similar advantages are achieved.

Figure 5:
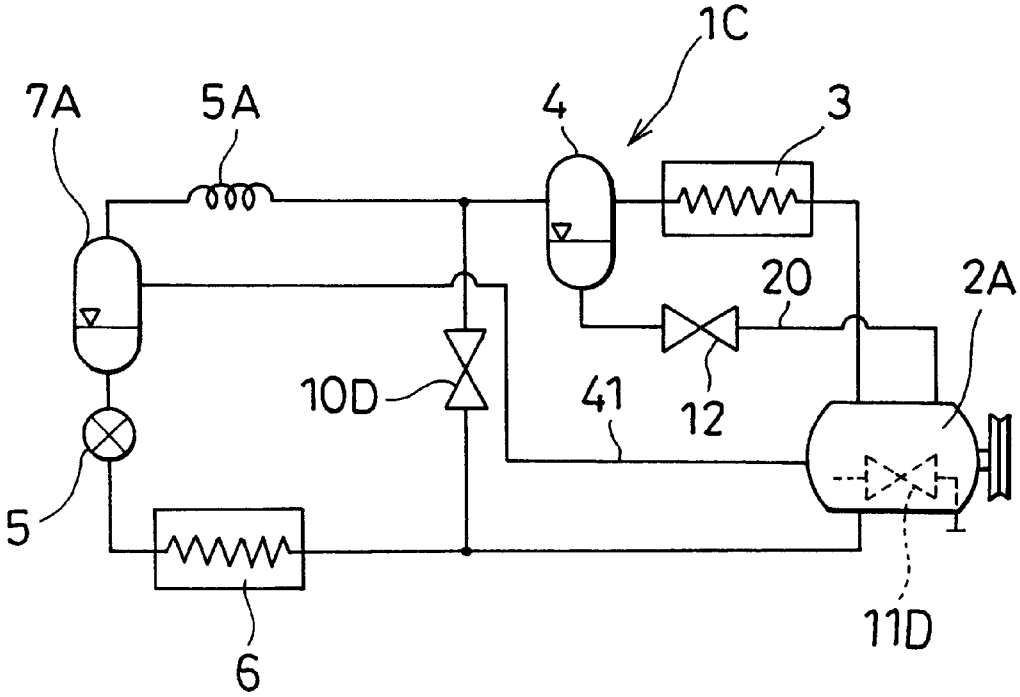
FIG. 5 is a schematic block diagram of the freezing cycle in a fifth embodiment.

A freezing cycle 1C in the fifth embodiment illustrated in FIG. 5 adopts a structure achieved by internally providing the second valve in the freezing cycle 1C in the fourth embodiment illustrated in FIG. 4 in a compressor 2A. It is to be noted that a first valve 10D in this embodiment is similar to the first valve explained earlier.

Figure 6:
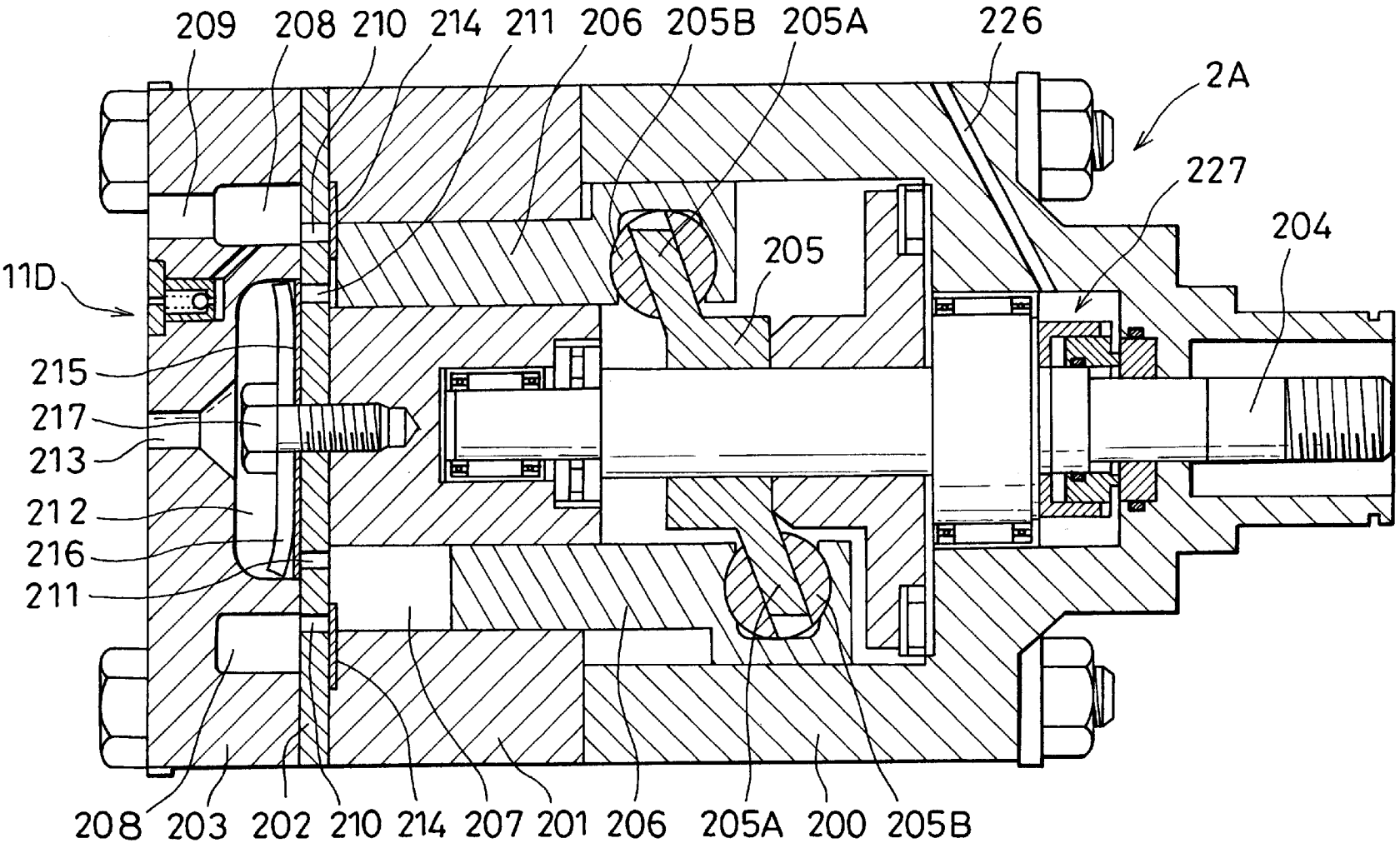
FIG. 6 is a sectional view of a compressor employed in the fifth embodiment.

FIG. 6 presents a structural example of the compressor 2A internally provided with the second valve 11D. The compressor 2A is provided with a housing constituted of a front block 200, a middle block 201, a plate 202 and a rear block 203 and is also provided with a drive shaft 204 passing through the center. A swash plate 205 is mounted to the drive shaft 204, and pistons 206 are each mounted at an inclined face plate 205A of the swash plate 205 via a ball bearing 205B. Pistons 206, which are slidably provided in a compression space 207 formed at the middle block 201, engage in reciprocal movement inside the compression space 207 as the swash plate 205 rotates.

At the rear block 203, a coolant intake hole 209 is provided. In addition, a toroidal coolant intake space 208 which communicates with the 209 is formed. At the plate 202, an intake hole 210 is formed at a position that corresponds to the position of the compression space 207 and an intake valve 214 is provided at the intake hole 210. In addition, an outlet hole 211 is formed at the plate 202, with an outlet valve 215 secured to the middle block 201 by a bolt 217 via a valve holding member 216. When the outlet valve 215 is secured, the plate 202 is also positioned and secured. The outlet hole 211 communicates with an outlet space 212 and also communicates with a coolant outlet hole 213. It is to be noted that reference number 226 in the compressor 2A indicates an oil return hole through which the oil from the oil separator 4 is returned to be supplied to a seal portion 227 of the drive shaft 204 thereby achieving a seal at the seal portion 227 and lubricating the bearing which holds a specific portion of the drive shaft 204.

Figure 7:
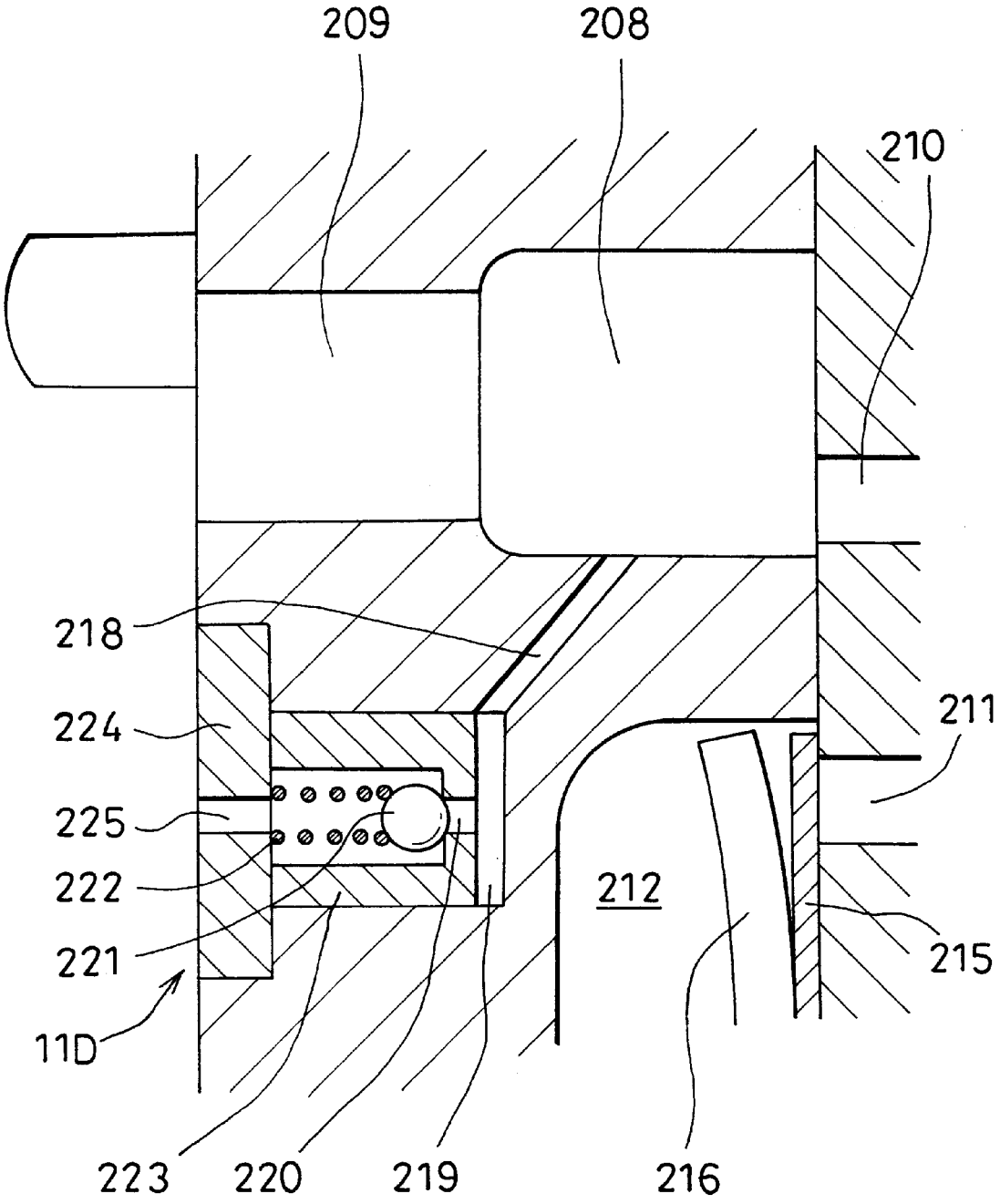
FIG. 7 is an enlarged sectional view of a portion of the compressor employed in the fifth embodiment.

As illustrated in FIG. 7, the second valve 11D mounted at the compressor 2A is constituted of a valve housing 223 mounted at low-pressure discharge passages 218 and 219 communicating with the coolant intake space 208, an opening 220 formed at the valve housing 223 and communicating with the low-pressure discharge passage 219, a ball valve 221 which closes the opening 220, a spring 222 which applies a pressure to the ball valve 221 toward the opening 220, a retaining plate 224 which secures the valve housing 223 and a release hole 225 formed at the retaining plate 224. In this structure, if the low-side pressure reaches a level equal to or higher than the pressure level determined by the spring 222, the ball valve 221 opens up the opening 220 to allow the coolant in the coolant intake space 208 to be released into the atmosphere until the low-side pressure becomes lower than the pressure level determined by the spring 222.

Figure 8:
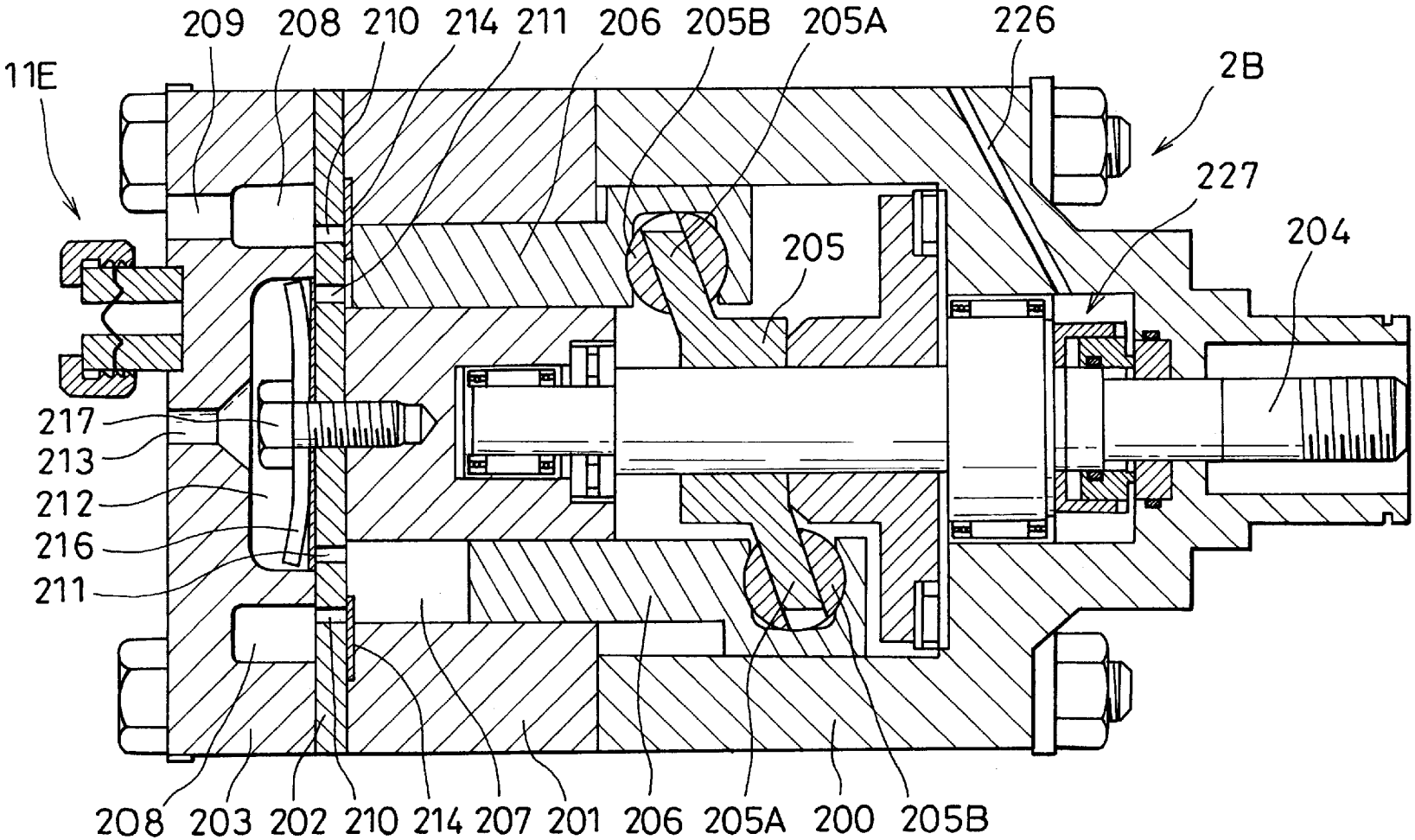
FIG. 8 is a sectional view of a compressor employed in a freezing cycle in a sixth embodiment.
Figure 9:
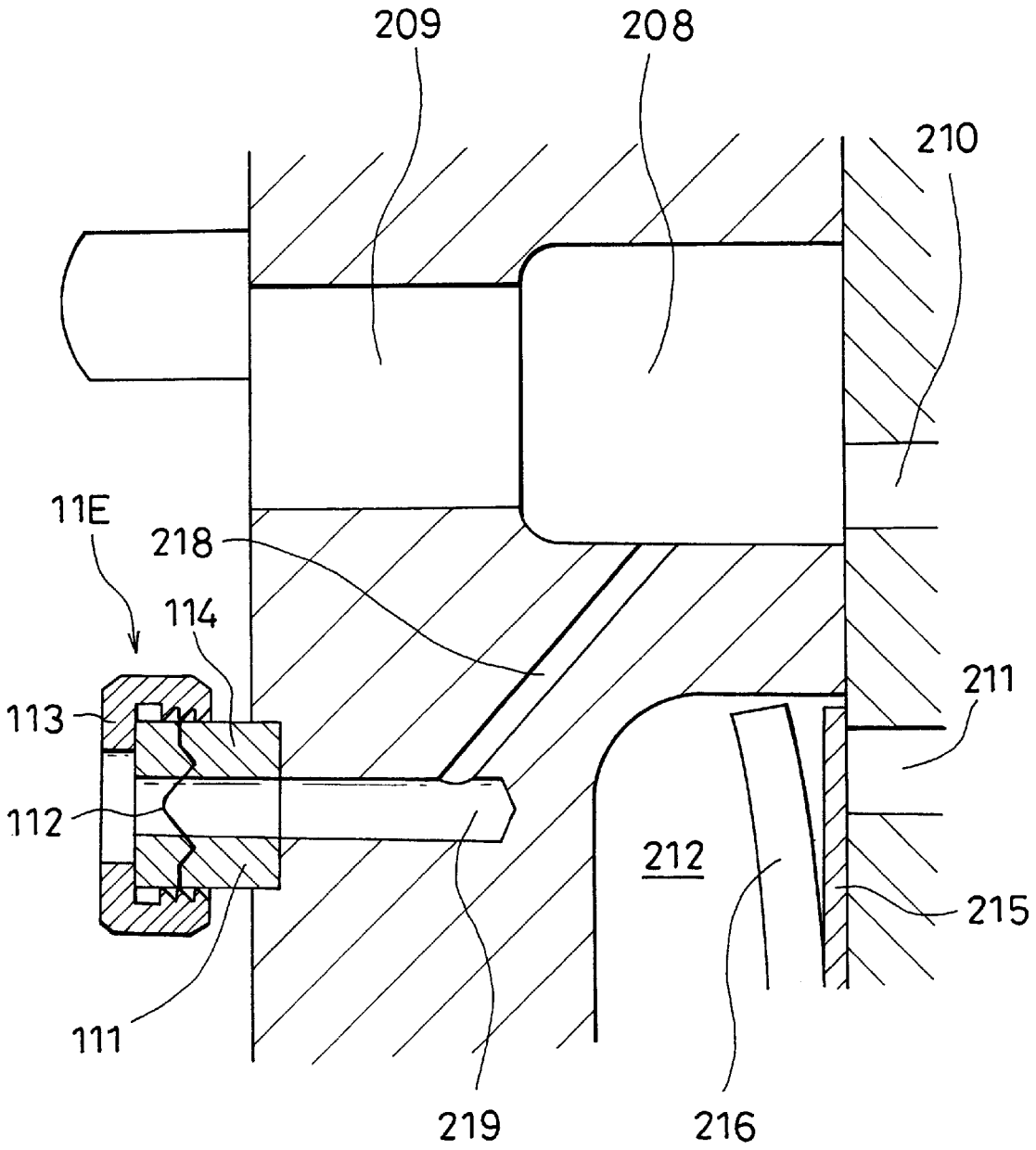
FIG. 9 is an enlarged sectional view of a portion of the compressor employed in the sixth embodiment.

FIGS. 8 and 9 illustrate the sixth embodiment in which a rupture disk mechanism 11E is provided instead of the relief valve as the second means for safety. In the sixth embodiment, the rupture disk mechanism 11E is provided at the front ends of the low-pressure discharge passages 218 and 219 communicating with the low-pressure coolant intake space 208. The rupture disk mechanism 11E is constituted of an outlet hole 114 communicating with the low-pressure discharge passage 219, a rupture disk 112 that closes off the outlet hole 114, a holding portion 111 that holds the rupture disk 112 and a retaining portion 113 that secures the rupture disk 112 to the holding portion 111. Thus, if the low level pressure in the coolant intake space 208 reaches a level equal to or higher than the specific value, the rupture disk 112 becomes ruptured to communicate the coolant intake space 208 with the atmosphere via the low-pressure discharge passage 219.

Figure 10:
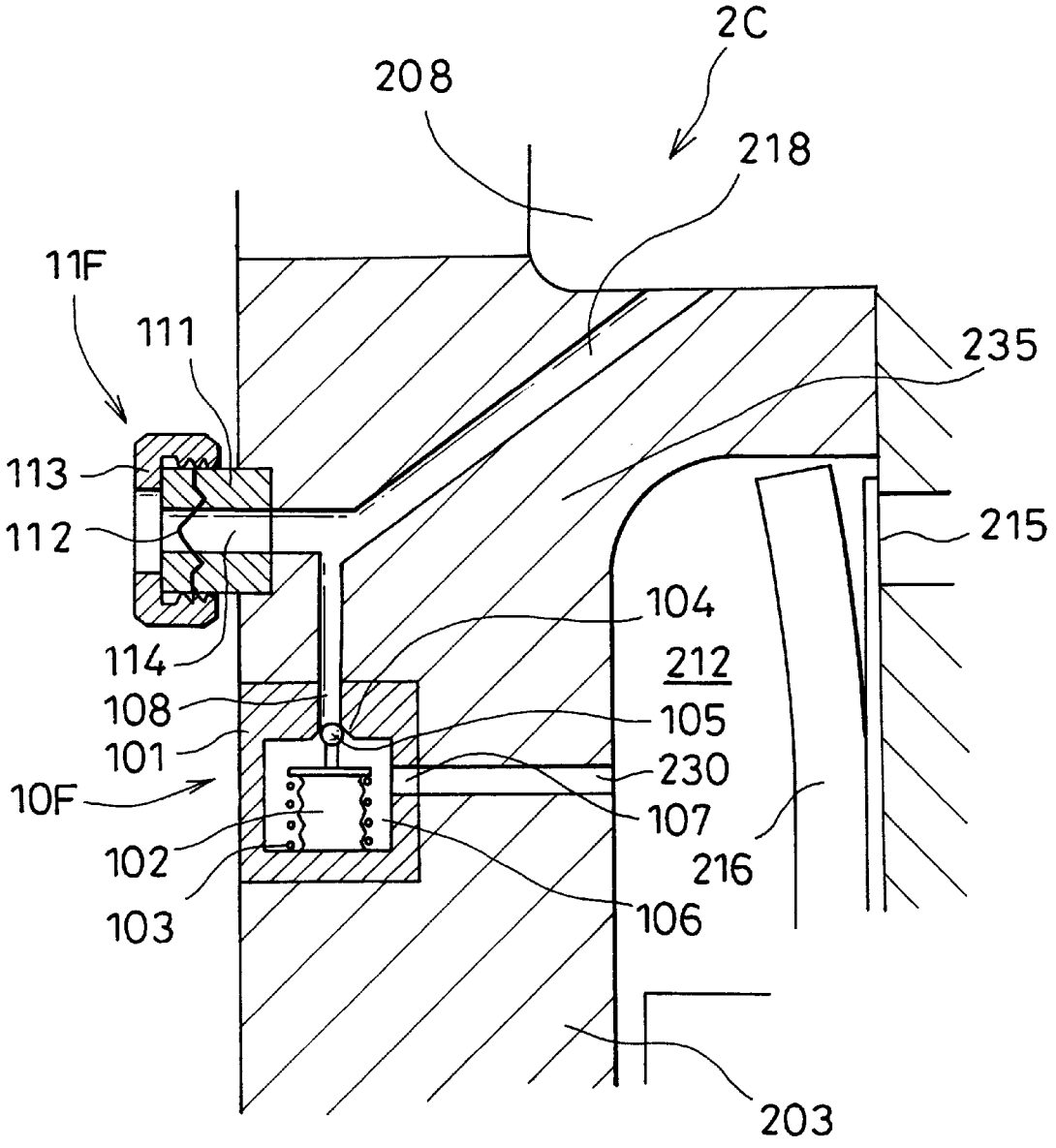
FIG. 10 is an enlarged sectional view of a portion of the compressor employed in a seventh embodiment.

FIG. 10 illustrates a structure achieved by providing the first means for safety and the second means for safety as an integrated unit at a compressor 2C in the freezing cycle in the seventh embodiment. A bellows-type valve 10F constituting the first means for safety is provided between a high-pressure discharge passage 230 and a low-pressure discharge passage 218 both formed within the rear block 203, and it is constituted of a valve housing 101 and the high-pressure space 106 defined within the valve housing 101. The bellows 102 is provided inside the high-pressure space 106, with a valve element 105 provided at the bellows 102. The valve element 105 sits at a valve seat 104 formed at the inner end of the low-pressure side communicating hole 108 communicating with the low-pressure discharge passage 218 to block off the low-pressure side communicating hole 108, thereby cutting off the communication between the high-pressure space 106 communicating with the high-pressure discharge passage 230 and the low-pressure discharge passage 218. In addition, if the pressure in the high-pressure space 106 becomes equal to or higher than a specific level, the bellows 102 becomes constricted against the force applied by the spring and, as a result, the valve element 105 departs from the valve seat 104 to allow communication between the high-pressure discharge passage 230 and the low-pressure discharge passage 218, thereby causing the high-side pressure to leak toward the low-pressure side and preventing an increase in the high-side pressure.

Furthermore, the rupture disk mechanism 11F constituting the second means for safety is provided at one end of the low-pressure discharge passage 218. The rupture disk mechanism 11F is similar to the rupture disk mechanism 11E explained earlier.

Thus, advantages similar to those achieved in the preceding embodiments are realized.

Figure 11:
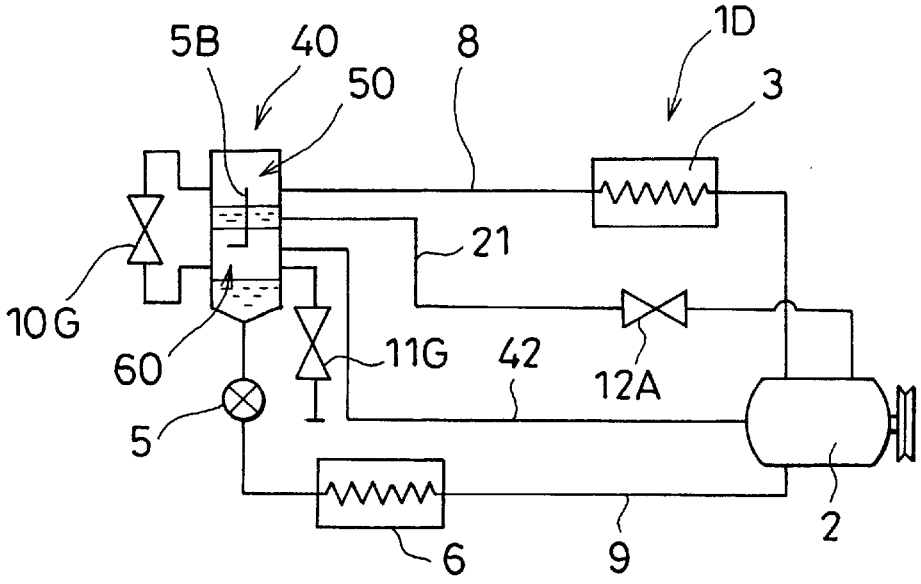
FIG. 11 is a schematic block diagram of the freezing cycle in an eighth embodiment.

A freezing cycle 1G in the eighth embodiment illustrated in FIG. 11 is characterized by a 3-layer separator 40 provided between the gas cooler 3 and the expansion valve 5.

The 3-layer separator 40 is constituted by forming an oil separation unit 50 and a gas/liquid separation unit 60 as an integrated unit via an orifice 5B constituting a first means for constriction. In this structure, the coolant which has become cooled by the radiator 3 flows into the oil separation unit 50 where the oil in the coolant becomes separated. The oil resulting from the separation is returned to the compressor 2 via an oil return line 21. In addition, the coolant having undergone the oil separation is let out into the gas/liquid separation unit 60 via the orifice 5B constituting the first means for constriction, where its pressure is reduced down to a level in the gas/liquid mixed range. During this process, the coolant is separated into a liquid-phase coolant and a gas-phase coolant, of which the gas-phase coolant is returned to the intake side of the compressor 2 via a gas-phase coolant return line 42. In addition, the liquid-phase coolant, with its pressure further reduced by the expansion valve 5 constituting a second means for constriction, reaches the evaporator 6 and becomes evaporated and then returns to the compressor 2.

In the eighth embodiment, a first valve 10G constituting the first means for safety is provided between the oil separation unit 50 and the gas/liquid separation unit 60, and if the high-side pressure reaches a level equal to or higher than the specific value, the high-pressure coolant is leaked to the gas/liquid separation unit 60 achieving an intermediate pressure level to prevent further increase in the high-side pressure. In addition, a second valve 11G constituting the second means for safety is provided between the gas/liquid separation unit 60 and the atmosphere. In this structure, the second valve 11G releases the pressure in the intermediate range between the high level and the low level into the atmosphere and thus, by releasing the coolant at the intermediate pressure, an increase in the low level pressure can be prevented, to achieve advantages similar to those realized in the preceding embodiments.

Figure 12:
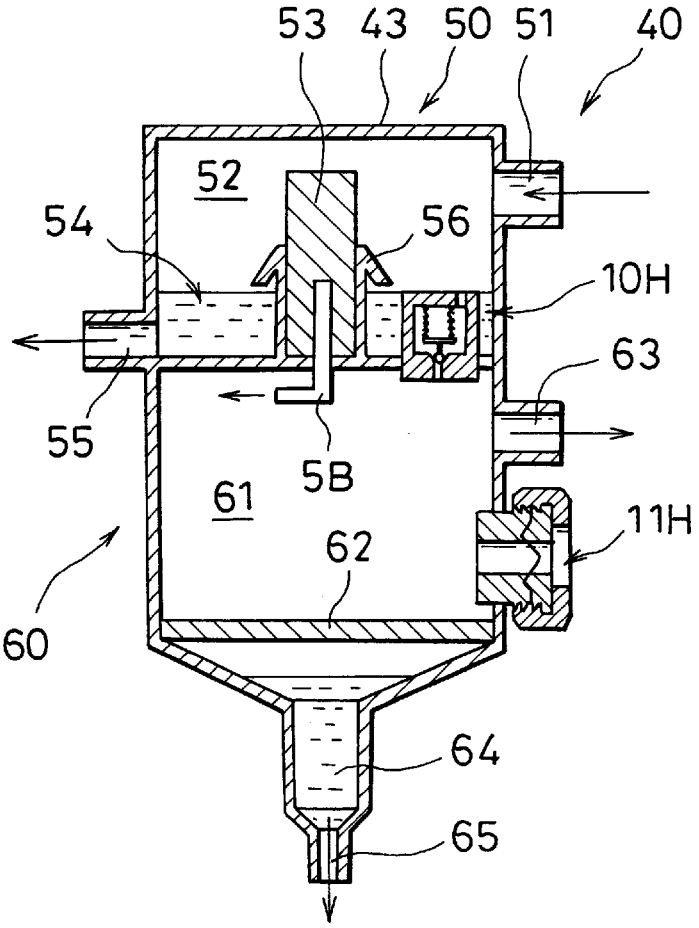
FIG. 12 is a schematic sectional view illustrating the structure adopted in the 3-layer separator employed in a ninth embodiment.

A 3-layer separator 40 in the ninth embodiment which is illustrated in FIG. 12, is constituted by forming the oil separation unit 50 and a gas/liquid separation unit 60 as an integrated unit inside a case 43, with the oil separation unit 50 and the gas/liquid separation unit 60 communicating with each other via an orifice 5B constituting a means for constriction.

The oil separation unit 50 is constituted of a coolant intake 51 communicating with the gas cooler 3, an oil separation space 52 communicating with the coolant intake 51 and an oil reservoir 54 where separated oil is collected, with an oil separation filter 53 provided on the intake side of the orifice 5B and an oil guide 56 provided around the oil separation filter 53 to titrate the oil into the oil reservoir 54 efficiently. In addition, the oil reservoir 54 communicates with an oil outlet 55 which communicates with the oil return line 21. It is to be noted that the oil which has flowed in with the coolant becomes separated through centrifugal separation or collision due to its own weight, or through a filter.

The gas/liquid separation unit 60 is constituted of a gas/liquid separation space 61, a gas/liquid separation filter 62 provided in the lower portion of the gas/liquid separation space 61, a gas-phase coolant outlet 63 through which the gas-phase coolant is discharged, a liquid-phase coolant reservoir 64 where the titrated liquid-phase coolant is collected and a liquid-phase coolant outlet 65. It is to be noted that the coolant is separated into the gas-phase coolant and the liquid-phase coolant through centrifugal separation or collision due to its own weight, or through a filter.

Furthermore, in the ninth embodiment, a first valve 10H constituting the first means for safety passes through a wall located between the oil separation space 52 and the gas/liquid separation space 61, whereas a rupture disk mechanism 11H constituting the second means for safety passes through a wall separating the gas/liquid separation space 61 from the atmosphere. It is to be noted that since the first valve 10H and the rupture disk mechanism 11H in the embodiment adopt structures identical to those explained earlier and achieve similar advantages, their explanation is omitted.

Figure 13:
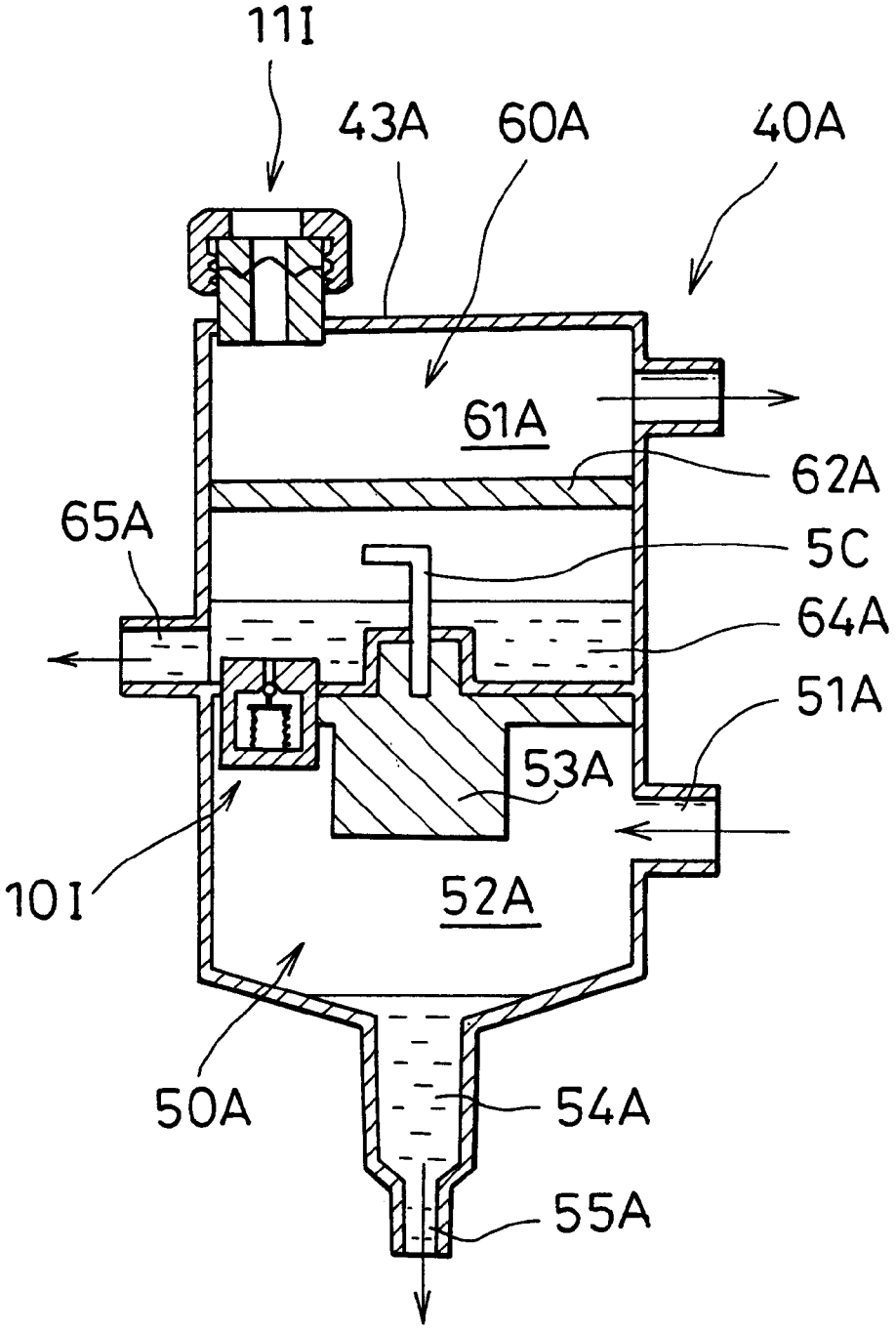
FIG. 13 is a schematic sectional view illustrating the structure adopted in the 3-layer separator employed in a tenth embodiment.

FIG. 13 illustrates another structure (40A) which may be adopted by the 3-layer separator 40, achieved by providing an oil separation unit 50A in the lower space inside a case 43A with a gas/liquid separation unit 60A provided above the oil separation unit 50A.

The oil separation unit 50A is constituted of a coolant intake 51A communicating with the gas cooler 3, an oil separation space 52A communicating with the coolant intake 51A and an oil reservoir 54A where separated oil is collected, with an oil separation filter 53A provided on the intake side of an orifice 5C. In addition, the oil reservoir 54A communicates with an oil outlet 55A communicating with the oil return line 21. It is to be noted that the oil having flowed in together with the coolant becomes separated through centrifugal separation or collision due to its own weight, or through a filter.

In addition, the gas/liquid separation unit 60A is constituted of a gas/liquid separation space 61A, a gas/liquid separation filter 62A provided inside the gas/liquid separation space 61A, a gas-phase coolant outlet 63A through which the gas-phase coolant is let out, a liquid-phase coolant reservoir 64A where the titrated liquid-phase coolant is collected and a liquid-phase coolant outlet 65A. It is to be noted that the coolant is separated into the gas-phase coolant and the liquid phase coolant through centrifugal separation or collision due to its own weight, or through a filter.

Furthermore, in this embodiment, a valve 101 constituting the first means for safety passes through a wall located between the oil separation space 52A and the gas/liquid separation space 61A, whereas a rupture disk mechanism 11I constituting the second means for safety passes through a wall separating the gas/liquid separation space 61A from the atmosphere. It is to be noted that since the first valve 10I and the rupture disk mechanism 11I in the embodiment adopt structures identical to those explained earlier and achieve similar advantages, their explanation is omitted.

Figure 14:
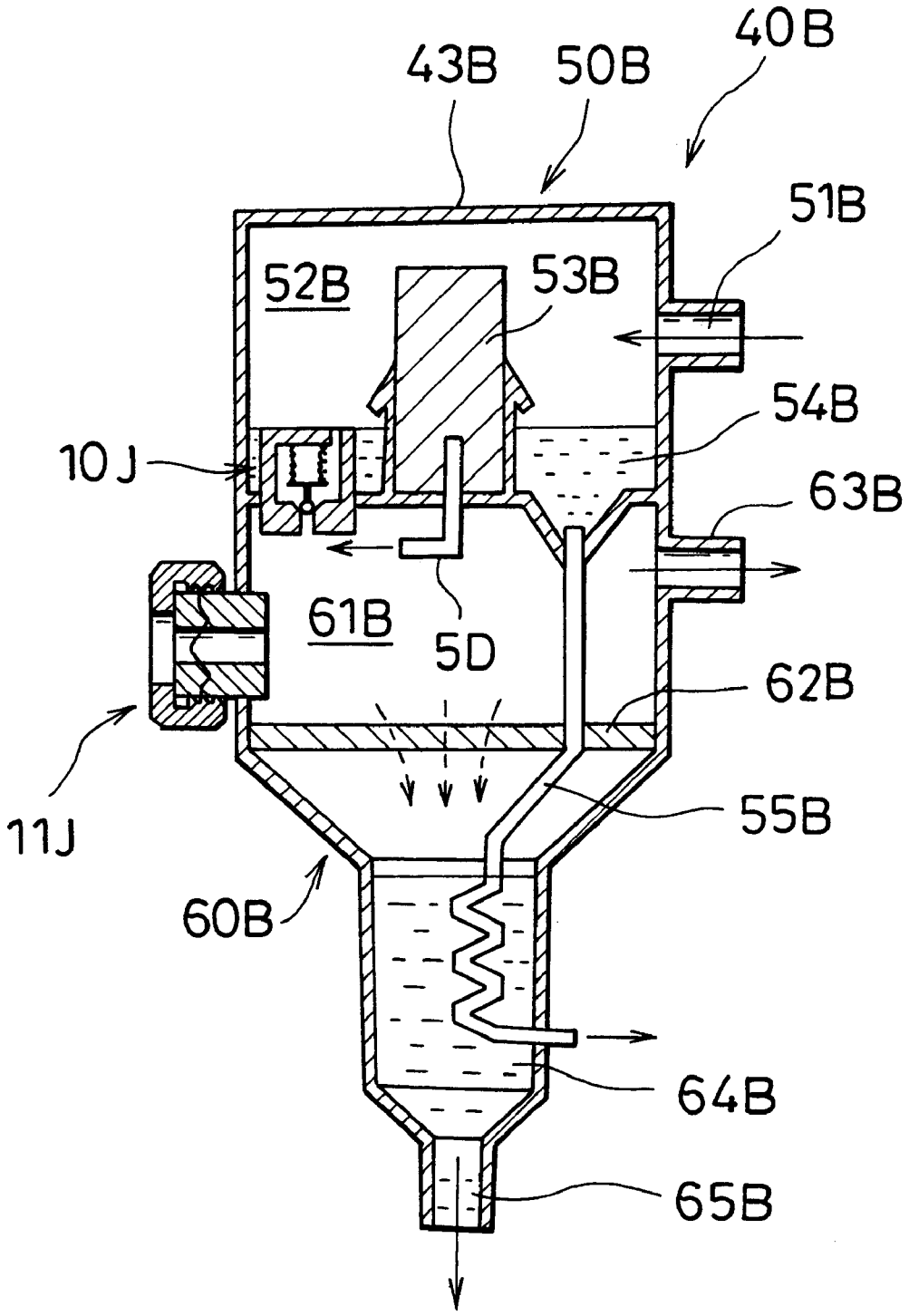
FIG. 14 is a schematic sectional view illustrating the structure employed in the 3-layer separator employed in a n eleventh embodiment.

A 3-layer separator 40B, which is illustrated in FIG. 14, is constituted by forming an oil separation unit 50B and a gas/liquid separation unit 60B as an integrated unit inside a case 43B, with the oil separation unit 50B and the gas/liquid separation unit 60B communicating with each other via an orifice 5D constituting a means for constriction.

The oil separation unit 50B is constituted of a coolant intake 51B communicating with the gas cooler 3, an oil separation space 52B communicating with the coolant intake 51B and an oil reservoir 54B where separated oil is collected, with an oil separation filter 53B provided on the intake side of an orifice 5D. In addition, the oil reservoir 55B communicates with an oil outlet piping 55B communicating with the oil return line 21, and the oil outlet piping 55*b* passes through the inside of a liquid-phase coolant reservoir 64B to be detailed below. Thus, since the oil can be cooled by the liquid-phase coolant, the compressor 2 itself can be cooled and at the same time the outlet temperature of the coolant can be lowered. It is to be noted that the oil having flowed in with the coolant becomes separated through centrifugal separation or collision due to its own weight, or through a filter.

In addition, the gas/liquid separation unit 60B is constituted of a gas/liquid separation space 61B, a gas/liquid separation filter 62B provided in the lower portion of the gas/liquid separation space 61B, a gas-phase coolant outlet 63B through which the gas-phase coolant is let out, the liquid-phase coolant reservoir 64B where the titrated liquid-phase coolant is collected and a liquid-phase coolant outlet 65B. It is to be noted that the coolant is separated into the gas-phase coolant and the liquid-phase coolant through centrifugal separation or collision due to its own weight, or through a filter.

Furthermore, in this embodiment, a valve 10J constituting the first means for safety passes through a wall located between the oil separation space 52B and the gas/liquid separation space 61B, whereas a rupture disk mechanism 11J constituting the second means for safety passes through a wall separating the gas/liquid separation space 61B from the atmosphere. It is to be noted that since the valve 10J and the rupture disk mechanism 11J in the embodiment adopt structures identical to those explained earlier and achieve similar advantages, their explanation is omitted.

Figure 15:
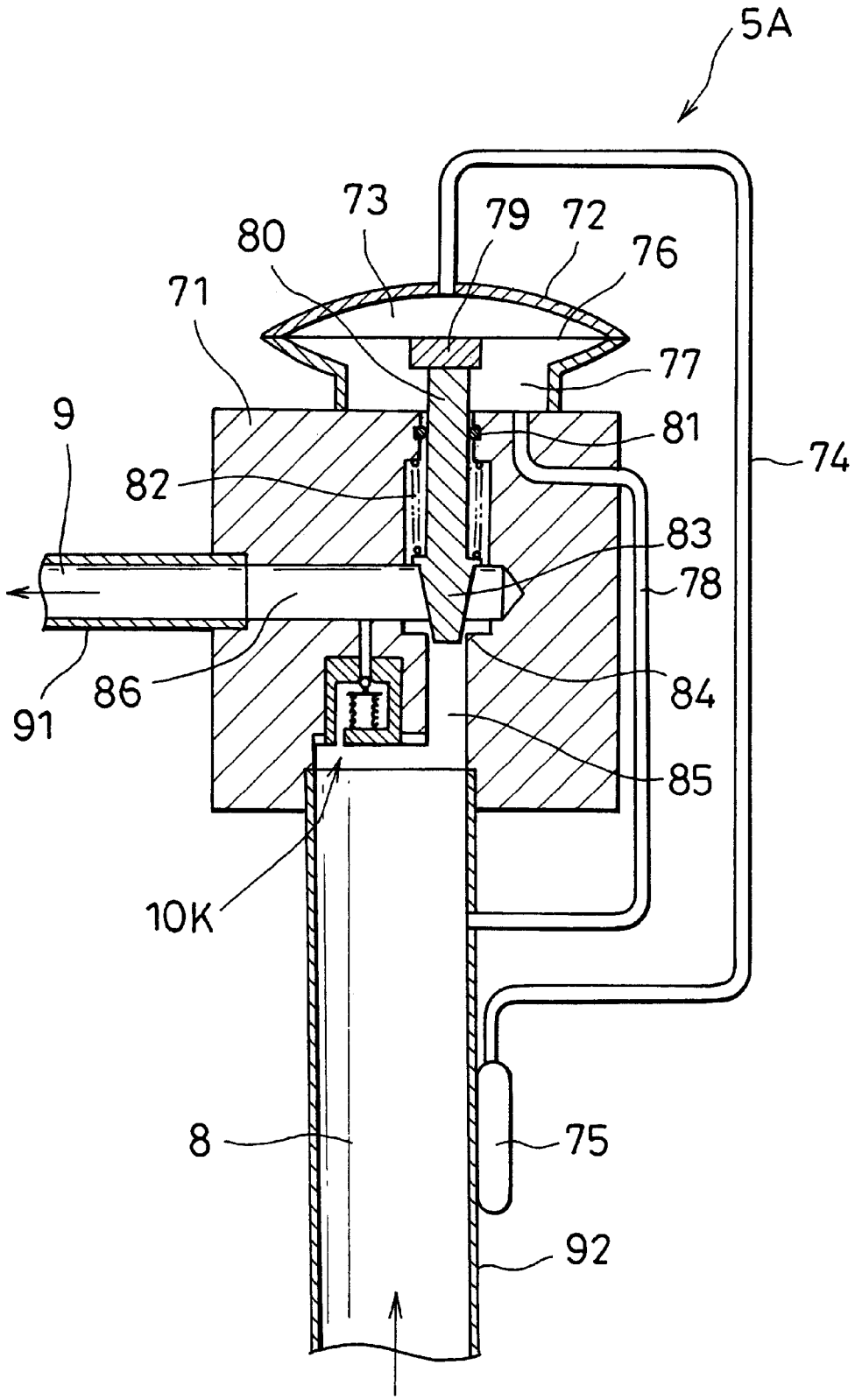
FIG. 15 is a schematic sectional view illustrating the structure of the expansion valve employed in a twelfth embodiment.

In the twelfth embodiment illustrated in FIG. 15, a first valve 10K is mounted at an expansion valve 5A.

To explain the expansion valve 5A in further detail, a block 71 at which a piping 92 connected to the gas cooler 3 and a piping 91 connected to the evaporator 6 are mounted is provided with a high-pressure passage 85 which extends continuously to a valve seat 84 and a low-pressure passage 86 formed perpendicular to the high-pressure passage 85 on the downstream side of the valve seat 84, with the high-pressure passage 85 connected to the piping 92 and the low-pressure passage 86 connected to the piping 91.

A force is applied by a spring 82 to a valve element 83 which moves relative to the valve seat 84 to change the communicating state (the constricting area) between the high-pressure passage 85 and the low-pressure passage 86 toward the valve seat 84. In addition, the valve element 83 is linked with a diaphragm 76 via a rod 80 and a linking piece 79, to allow the constricting area to be changed through the vertical movement of the diaphragm 76.

A pressure space 77 formed on the lower side of the diaphragm 76 becomes communicated with the inside of the piping 92 to allow supply of the high-pressure coolant, and if the high-side pressure is high, the diaphragm 76 is pressed upward to move the valve element 83 upward so as to increase the constricting area to reduce the high-side pressure. In addition, a pressure space 73 formed on the upper side of the diaphragm 76 communicates with the space inside a temperature-detecting cylinder 75 mounted at the piping 92, with the same type of coolant as the coolant used in the freezing cycle sealed within the pressure space 73. Thus, if the temperature inside the piping 92 rises, the coolant temperature inside the temperature-detecting cylinder 75 also rises and the coolant becomes expanded, thereby causing an increase in the pressure in the pressure space 73 and causing the valve element 83 move downward to reduce the constricting area, which, in turn, increases the degree to which the temperature is lowered to ensure that the temperature of the coolant is lowered to a sufficient degree. It is to be noted that reference number 72 indicates a case within which the pressure spaces 73 and 77 are formed, with the peripheral edge of the diaphragm 76 securely held at the case 72.

In this embodiment, the first valve 10K is provided as an integrated unit at a block 71 of the expansion valve 5A so as to bypass the valve mechanism constituted of the valve element 83 and the valve seat 84. As a result, advantages similar to those achieved in the preceding embodiments are realized.

Figure 16:
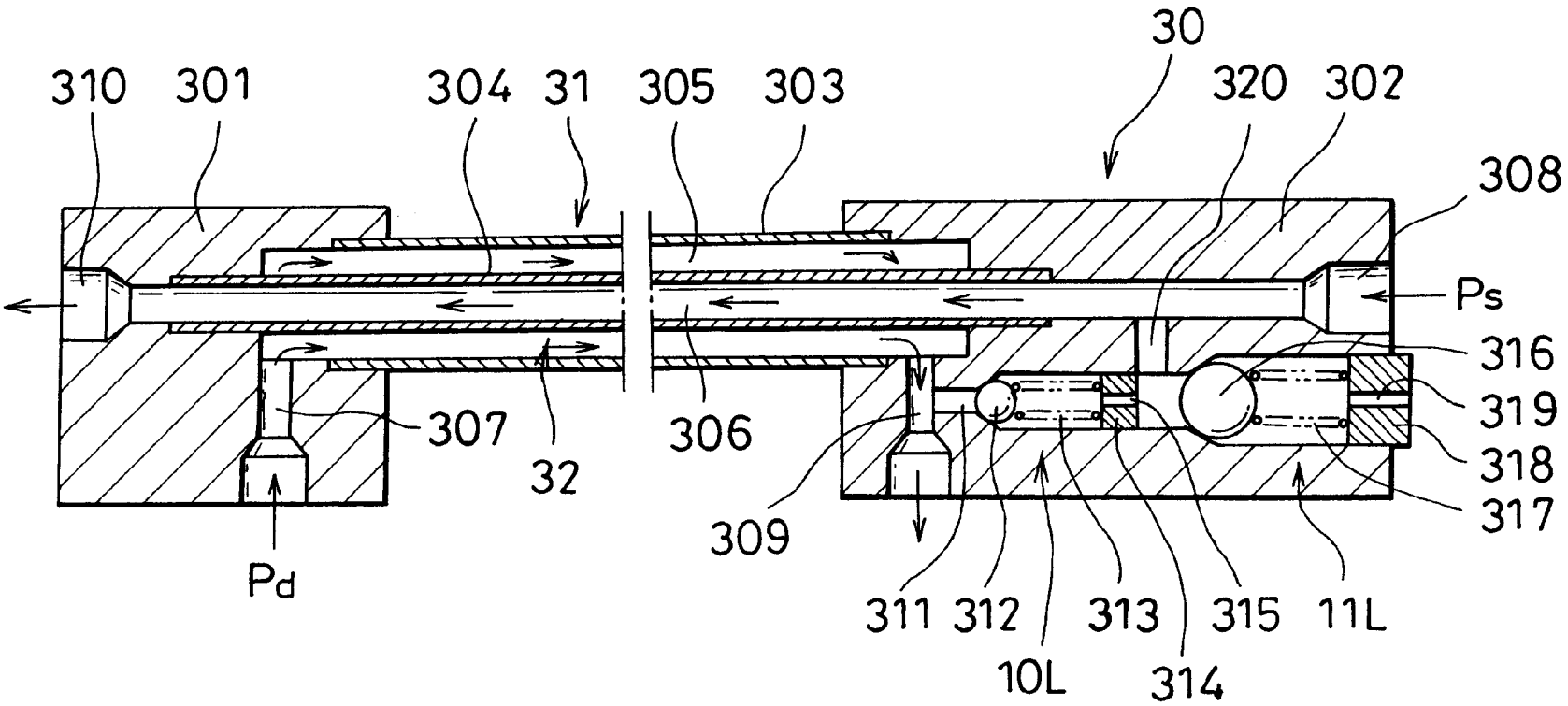
FIG. 16 is a schematic sectional view illustrating the structure of the internal heat exchanger employed in a thirteenth embodiment.

The thirteenth embodiment illustrated in FIG. 16 adopts a structure achieved by utilizing a simple relief valve 10L to constitute the first means for safety and utilizes a recoverable relief valve 11L instead of the rupture disk mechanism to constitute the second means for safety, unlike the embodiments explained earlier. To explain this structure in reference to an embodiment in which the first and second means for safety are provided at the internal heat exchanger 30, a high-pressure side valve passage 311 communicating with the high-pressure side outlet passage 309 is formed at the block 302, with the high-pressure side valve passage 311 closed off by a ball valve 312 which is pressed against the opening end of the high-pressure side valve passage 311 by a spring 313. It is to be noted that reference number 314 indicates a spring holding member with a communicating hole 315 in a specific size formed at its center to allow it to communicate with a low-pressure side intake passage 308 via a low-pressure side valve passage 320.

Thus, since the ball valve 312 opens up the high-pressure side valve passage 311 if the pressure in the high-pressure line 8, i.e., the pressure in the high-pressure side outlet passage 309, reaches a level equal to or higher than a specific pressure level (set at a value within the range of 12 MPa~20 MPa) and the pressure difference between the pressure in high-pressure line 8 and the pressure in the low-pressure line 9 exceeds the level of the force applied by the spring 313, resulting in the high-pressure side valve passage 311 and the low-pressure side valve passage 320 communicating with each other, the coolant in the high-pressure line 8 is allowed to flow into the low-pressure line 9 until the pressure difference between the high-pressure line 8 and the low-pressure line 9 becomes smaller than the preset level of the force applied by the spring 313. In addition, one end of the low-pressure side valve passage 320 is closed off by the ball valve 308 pressed by a spring 317. The force applied by the spring 317 is set at a value between 8 MPa and 15 MPa. Reference number 318 indicates a spring holding member with a communicating hole 319 formed at its center which communicates between the low-pressure side valve passage 320 and the atmosphere if the pressure difference between the low level pressure and the atmospheric pressure becomes larger than the preset value, thereby allowing the coolant to be released until the low level pressure returns to a specific value. As a result, advantages similar to those explained in reference to the preceding embodiments are realized.

INDUSTRIAL APPLICABILITY

As explained above, according to the present invention in which the valve connecting the high-pressure line and the low-pressure line is opened if the high-side pressure reaches a level equal to or higher than a specific pressure to absorb the increase in the high-side pressure on the low-pressure side by allowing the high-pressure coolant to flow toward the low-pressure side, the increase in the high-side pressure is minimized while retaining the coolant and, as a result, the various components in the freezing cycle are protected against an abnormally high pressure while maintaining a constant coolant quantity in the freezing cycle, to achieve a stable operation of the freezing cycle.

In addition, since the coolant is released into the atmosphere only when the low level pressure reaches a level equal to or higher than a specific pressure, the safety of the various components in the freezing cycle can be assured while minimizing the quantity of coolant released into the atmosphere.

As explained above, since the need to increase the pressure withstanding performance of the various components by a great degree is eliminated, the cost of the components can be lowered.

What is claimed is:

1. A freezing cycle comprising, at least: a compressor that compresses a gas-phase coolant to achieve a pressure in a supercritical range; a radiator that cools said gas-phase coolant compressed by said compressor; a means for constriction that lowers the pressure of said gas-phase coolant that has been cooled down to a range in which liquid-phase coolant is present; and an evaporator that evaporates said liquid-phase coolant obtained through said means for constriction, having a high-pressure line extending from said compressor to said means for constriction and a low-pressure line extending from said means for constriction to said compressor, characterized by comprising:

a first means for safety that communicates between said high-pressure line and said low-pressure line if the pressure in said high-pressure line reaches a first pressure; and a second means for safety provided at said low-pressure line, that opens said low-pressure line to the atmosphere if the pressure in said low-pressure line reaches a second pressure.

2. A freezing cycle according to claim 1, characterized by comprising:

a first heat exchanger located between said radiator and said means for constriction; and a second heat exchanger located between said evaporator and said compressor, wherein:

an internal heat exchanger is provided to achieve heat exchange between said first heat exchanger and said second heat exchanger;

said first means for safety is provided between said first heat exchanger and said second heat exchanger; and said second means for safety is provided between said second heat exchanger and the atmosphere.

3. A freezing cycle according to claim 1, characterized in that:

said second means for safety is provided inside said compressor and opens the intake side of said compressor to the atmosphere if the pressure on the intake side of said compressor reaches a level equal to or higher than a specific value.

4. A freezing cycle according to claim 3, characterized in that:

said first means for safety is provided inside said compressor to communicate between the outlet side and the intake side of said compressor if the pressure on the outlet side of said compressor reaches a level equal to or higher than a specific value.

5. A freezing cycle according to claim 1, characterized in that:

said means for constriction is an expansion valve and said first means for safety communicates between the upstream side and the downstream side of said expansion valve.

6. A freezing cycle according to claim 1, characterized in that;

said first means for safety is constituted of a bellows-type valve provided with a bellows that contracts at said first pressure level.

7. A freezing cycle according to claim 1, characterized in that;

said first means for safety is constituted of a relief valve that opens at said first pressure level.

8. A freezing cycle according to claim 1, characterized in that;

said second means for safety is constituted of a rupture disk that ruptures at said second pressure level.

9. A freezing cycle according to claim 1, characterized in that;

said second means for safety is constituted of a relief valve that opens at said second pressure level.

10. A freezing cycle according to claim 2, characterized in that;

said first means for safety is constituted of a bellows-type valve provided with a bellows that contracts at said first pressure level.

11. A freezing cycle according to claim 3, characterized in that;

said first means for safety is constituted of a bellows-type valve provided with a bellows that contracts at said first pressure level.

12. A freezing cycle according to claim 4, characterized in that;

said first means for safety is constituted of a bellows-type valve provided with a bellows that contracts at said first pressure level.

13. A freezing cycle according to claim 5, characterized in that;

said first means for safety is constituted of a bellows-type valve provided with a bellows that contracts at said first pressure level.

14. A freezing cycle according to claim 2, characterized in that;

said first means for safety is constituted of a relief valve that opens at said first pressure level.

15. A freezing cycle according to claim 3, characterized in that, said first means for safety is constituted of a relief valve that opens at said first pressure level.

16. A freezing cycle according to claim 4, characterized in that;

said first means for safety is constituted of a relief valve that opens at said first pressure level.

17. A freezing cycle according to claim 5, characterized in that;

said first means for safety is constituted of a relief valve that opens at said first pressure level.

18. A freezing cycle according to claim 2, characterized in that;

said second means for safety is constituted of a rupture disk that ruptures at said second pressure level.

19. A freezing cycle according to claim 3, characterized in that;

said second means for safety is constituted of a rupture disk that ruptures at said second pressure level.

20. A freezing cycle according to claim 4, characterized in that;

said second means for safety is constituted of a rupture disk that ruptures at said second pressure level.

21. A freezing cycle according to claim 5, characterized in that;

said second means for safety is constituted of a rupture disk that ruptures at said second pressure level.

22. A freezing cycle according to claim 6, characterized in that;

said second means for safety is constituted of a rupture disk that ruptures at said second pressure level.

23. A freezing cycle according to claim 7, characterized in that;

said second means for safety is constituted of a rupture disk that ruptures at said second pressure level.

24. A freezing cycle according to claim 2, characterized in that;

said second means for safety is constituted of a relief valve that opens at said second pressure level.

25. A freezing cycle according to claim 3, characterized in that;

said second means for safety is constituted of a relief valve that opens at said second pressure level.

26. A freezing cycle according to claim 4, characterized in that;

said second means for safety is constituted of a relief valve that opens at said second pressure level.

27. A freezing cycle according to claim 5, characterized in that;

said second means for safety is constituted of a relief valve that opens at said second pressure level.

28. A freezing cycle comprising: a compressor that compresses a gas-phase coolant to achieve a pressure in a supercritical range; a radiator that cools said gas-phase coolant having been compressed by said compressor; a means for oil separation that is provided on the downstream side relative to said radiator and separates oil from said coolant which has been cooled; a first means for constriction that lowers the pressure of said gas-phase coolant having undergone oil separation at said means for oil separation down to a range in which a liquid-phase coolant is present; a means for gas/liquid separation that separates said coolant set in a gas/liquid mixed state by said first means for constriction into a gas-phase component and a liquid-phase component; a second means for constriction that further reduces the pressure of said liquid-phase coolant resulting from said separation at said means for gas/liquid separation; and an evaporator that evaporates said liquid-phase coolant with the pressure thereof having been lowered by said second means for constriction, having a high-pressure line extending from said compressor to said first means for constriction, an intermediate-pressure line extending from said first means for constriction to said second means for constriction and a low-pressure line extending from said second means for constriction to said compressor, characterized in that;

a first means for safety is provided between said means for oil separation and said means for gas/liquid separation to communicate between said high-pressure line and said intermediate-pressure line at a first pressure; and a second means for safety is provided between said means for gas/liquid separation and the atmosphere to communicate between said intermediate-pressure line and the atmosphere at a third pressure higher than a second pressure.

29. A freezing cycle according to claim 28, characterized by having a 3-layer separator located between said radiator and said second means for constriction, constituted by providing said means for oil separation, said first means for constriction and said means for gas/liquid separation as an integrated unit.

30. A freezing cycle according to claim 28, characterized in that;

said first means for safety is constituted of a bellows-type valve provided with a bellows that contracts at said first pressure level.

31. A freezing cycle according to claim 29, characterized in that;

said first means for safety is constituted of a bellows-type valve provided with a bellows that contracts at said first pressure level.

32. A freezing cycle according to claim 28, characterized in that;

said first means for safety is constituted of a relief valve that opens at said first pressure level.

33. A freezing cycle according to claim 29, characterized in that;

said first means for safety is constituted of a relief valve that opens at said first pressure level.

34. A freezing cycle according to claim 28, characterized in that;

said second means for safety is constituted of a rupture disk that ruptures at said second pressure level.

35. A freezing cycle according to claim 29, characterized in that;

said second means for safety is constituted of a rupture disk that ruptures at said second pressure level.

36. A freezing cycle according to claim 28, characterized in that;

said second means for safety is constituted of a relief valve that opens at said second pressure level.

37. A freezing cycle according to claim 29, characterized in that;

said second means for safety is constituted of a relief valve that opens at said second pressure level.

* * * * *